United States Patent [19]

Mendell, Jr.

[11] 3,953,014

[45] Apr. 27, 1976

[54] HOLDING MEANS

[76] Inventor: Lester W. Mendell, Jr., 1432 Mariposa, Corona, Calif. 91720

[22] Filed: Feb. 24, 1975

[21] Appl. No.: 552,322

[52] U.S. Cl. ..... 269/43; 249/91; 269/254 R; 269/321 W

[51] Int. Cl.[2] ..... B22D 5/00; B25B 5/14

[58] Field of Search ..... 269/37, 40, 43, 45, 269/275, 254 R, 317, 321 W; 249/91, 94, 95

[56] References Cited

UNITED STATES PATENTS

| | | | |
|---|---|---|---|
| 352,476 | 11/1886 | Lustig | 249/91 |
| 728,450 | 5/1903 | Everett | 269/43 |
| 3,201,874 | 8/1965 | Christy | 269/43 |
| 3,610,613 | 10/1951 | Worden | 269/254 R |
| 3,690,614 | 9/1972 | Cherniak | 249/95 |

*Primary Examiner*—Al Lawrence Smith
*Assistant Examiner*—Robert C. Watson
*Attorney, Agent, or Firm*—John H. Crowe

[57] ABSTRACT

A rack for holding the sides of a flat-sided plastic napkin holder vertical while the bottom of the holder is being molded. The rack includes a wire basket of generally box-like shape with vertical sides and a bottom formed from segments of stiff wire. In addition to the wire basket, the rack includes a rectangular sheet of relatively stiff, resilient polyethylene which is held fast at the middle by the bottom of the basket frame so that the halves of the sheet extend upwardly and press outwardly against two of the basket sides to give it a U-shaped profile in side view. The wire basket has three short legs to support it firmly on the rim of a mold for casting the bottom of the napkin holder. To use the device, preformed sides of the plastic napkin holder are forced between the two halves of the polyethylene sheet and confronting sides of the wire basket so that the pressing halves of the sheet hold the napkin holder sides in position against the basket without slippage. The rack with the napkin holder sides thus positioned is placed on top of the casting mold for the bottom of the napkin holder and the napkin holder sides are then pushed downwardly into the mold cavity, where they are held upright, in precisely coplanar relationship, until the bottom of the napkin holder is cast.

6 Claims, 5 Drawing Figures

HOLDING MEANS

BACKGROUND OF THE INVENTION

This invention relates generally to means for firmly supporting the preformed sides of flat-sided, open-topped objects with molded bottoms in upright positions while the bottoms are being molded, and more particularly to such means for steadily holding the preformed sides of open-topped, flat-bottomed napkin holders upright during formation of the napkin holder bottoms.

An extremely popular item of merchandise, judging by the frequency with which it is seen in gift and curio shops, as well as other outlets for novelty and the like items, is the ordinary napkin holder of the type having a pair of relatively flat, planarly parallel sides joined by a flat bottom of molded plastic construction. The sides of these napkin holders are often, similarly to their bottoms, of molded plastic construction. Sometimes the plastic is of a transparent character, and the napkin holder sides are formed with embedded decorative objects of one sort or another. For example, it is presently fashionable to embed miniature "memory" or "ecology boxes" having partitioned spaces filled with such things as small flower stalks, seeds, sheafs of grain, and the like, in the sides of such napkin holders.

Napkin holders of the above-described type are of relatively simple construction but their present methods of manufacture are so crude and primitive that many of them are misshapen. Where the napkin holders have plastic sides, the sides are generally cast separately and then arranged in standing pairs, after which plastic webs are molded between the bottom edges of the pairs to form the final holders with integral sides and bottoms. For this operation, the two sides of each napkin holder are supported in upright, planarly parallel positions with their bottom edges extending into the hollow of a mold adapted to receive a pourable resinous material of a type adapted to form the plastic web between said edges. Insofar as I am aware, the most common method heretofore practiced for supporting the sides of napkin holders in position while the napkin holder bottoms are being formed is to first support slotted boards at their ends in positions overlying rows of molds for the napkin holder bottoms, the slots in the boards being, typically, about 6 feet long. The napkin holder sides are then inserted manually through the slots and into the molds, after which the napkin holder bottoms are formed in the molds.

While the above-described method of making napkin holders serves its purpose after a fashion, the resulting products are oftentimes improperly formed because the slots in the boards are too imprecisely defined and positioned to permit good control of product quality during the operation, the boards are relatively easily shifted out of properly aligned positions with the molds, and a high probability of human error is inherent in such a crude manufacturing procedure. This accounts for the many imperfectly formed napkine holders on display in novelty shops, and the like, such as, for example, napkin holders with sides closer together at the top than at the bottom. While these imperfectly formed napkin holders can, for the most part, be made to serve their purpose, they are obviously neither as functional nor attractive as properly formed, perfectly symmetrical napkin holders, nor possessed of the same sales appeal as the latter. While it is common knowledge that flawed, or imperfect, merchandise will not sell as readily as unflawed merchandise of the same sort, no one has yet, to my knowledge, provided a commercially competitive way of turning out top quality napkin holders of the type under present consideration with dependable consistency, to meet the obviously huge demand for such items.

SUMMARY OF THE INVENTION

I have now, by this invention, provided a simple and relatively inexpensive device for holding the sides of napkin holders of the above-described type in positions of upright symmetry for the production of well-shaped products of uniform quality and attractiveness and good sales appeal. All of this is made possible through the utilization of a rack of unique design which includes a flat-sided basket and yielding pressure means cooperative with the basket to support a pair of preformed napkin holder sides in upright, planarly parallel relationship while a molded bottom for the napkin holder is formed integral with said sides. The yielding pressure means is preferably a sheet of resilient polyethylene plastic bent into the shape of a U and fixedly secured in position in the basket so that its halves press outwardly against a pair of confronting sides of the latter with a firm but yielding pressure. The performed napkin holder sides can be easily inserted between the halves of the polyethylene sheet and the confronting sides of the basket, and the rack is designed to stand firmly on the rim of a cooperating mold for the casting of the bottom of the napkin holder from a suitable resin. The rack, in its preferred form, can be quickly and easily made from suitably shaped lengths of steel wire and a properly sized sheet of polyethylene plastic by spot welding the lengths of wire into the form of said basket and, in the process, anchoring the middle of the polyethylene sheet across the bottom of the basket by wedging it in position with certain of the wire lengths so that its two halves bear outwardly against the confronting basket sides referred to above.

The method of using the novel rack of this invention is extremely simple and within the capabilities of virtually anyone. First, the pair of preformed napkin holder sides are inserted in the rack between the halves of the polyethylene sheet, or its equivalent, and the adjacent sides of the basket, and the rack is then placed on the rim of the casting mold for the bottom of the napkin holder, the rack being positioned on the mold so that the two napkin holder sides fit into the mold cavity or can be pushed downwardly thereinto. The napkin holder sides are next pushed downwardly as necessary, until their bottom edges are properly positioned in the mold. A suitable liquid resin mix is then poured into the mold cavity and allowed to set. Finally, the rack is lifted away from the mold, carrying the completed napkin holder with it, and the latter is then pulled out of the rack by hand.

It is thus a principal object of this invention to provide relatively simple, inexpensive and lightweight means for holding the sides of conventional open-topped napkin holders in positions of proper symmetry while molded plastic bottoms for the napkin holders are being cast.

It is another object of the invention to provide such means of substantially fool-proof character which can be used by virtually anyone capable of employment for use in the production of napkin holders of uniformly high quality and appearance.

Other objects, features and advantages of the invention will become apparent to those skilled in the art in the light of subsequent disclosures herein.

BRIEF DESCRIPTION OF THE DRAWINS

DESCRIPTION OF THE PREFERRED EMBODIMENT

Figure 1:
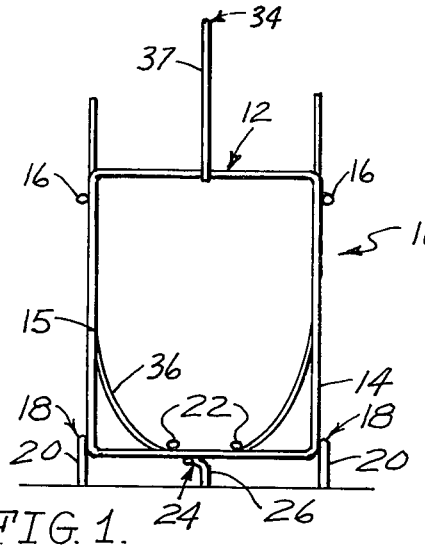
FIG. 1 is an end elevation of a preferred form of rack in accordance with this invention for holding a pair of napkin holder sides in position while a bottom for the napkin holder is being molded.
Figure 2:
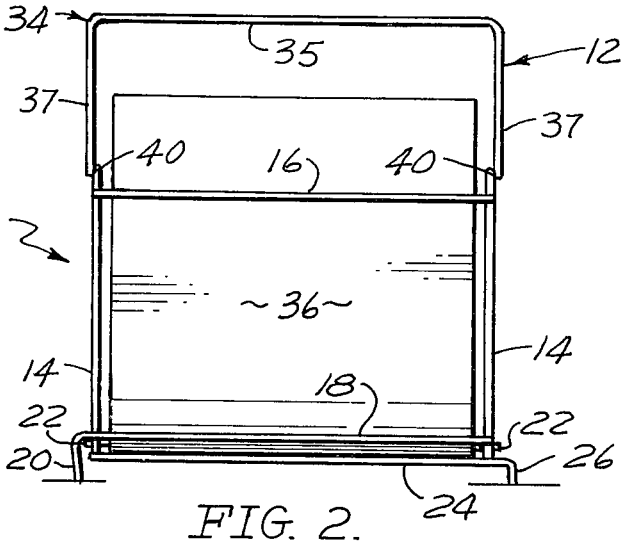
FIG. 2 is another elevation of the rack, as seen from the right of its FIG. 1 position.

Considering now the drawing in greater detail, with emphasis first on FIGS. 1 and 2, there is shown generally at 10 a preferred embodiment of a napkin holder side rack in accordance with this invention. Rack 10 serves the purpose of holding and maintaining the two sides of a conventional type of napkin holder in precisely spaced, planarly parallel positions during molding of the bottom of the napkin holder as an integral web joining the bottoms of the sides to form a flat base for the finished product. The rack 10 consists of a wire basket 12, formed preferably of cold-rolled steel rod stock, and a cooperating sheet of resilient plastic material 36, preferably formed from polyethylene sheet-stock of 90-mil thickness, although it can be of any other suitable material and/or thickness for the purpose, such as, for example, of 60-mil polyethylene.

As the drawing shows, wire basket 12 is of box-like character and formed from a pair of rectangular end members 14 held in alignment, at the proper distance apart, by a parallel pair of top rail segments 16 and a pair of bottom rails 18, all formed from the same-sized cold-rolled steel rod stock. The rectangular ends 14 of basket 12 are each formed from a single segment of the rod stock, which is bent into the proper shape and welded to itself at its meeting ends. The resulting welded joint for one of the end members is shown at 15 in FIGS. 1, 3 and 4. The top rails 16, bottom rails 18 and rectangular end members 14 are spot-welded at appropriate points to join them into an integral whole. In addition to the parts already described, basket 12 has a top handle 34 consisting of an elongate straight segment 35, suitable for hand-gripping purposes, and a pair of downturned ends 37. This handle is positioned midway between the sides of the basket and is so sized and disposed that the lower tips of its downturned ends 37 closely straddle horizontal top segments of the end members 14, where they are spot-welded to said horizontal top member, as shown at 40 in FIG. 2.

Running across the bottom of the rack 12, from one end to the other, are a pair of parallel rod segments 22, these segments being spot-welded at their ends to the upper sides of horizontal bottom segments of the end members 14. While the dimensions of basket 12 can vary, depending primarily upon the size of napkin holder contemplated by the user, the majority of napkin holders of the type under present consideration are of fairly standardized size and shape, and I have found that for the production of such napkin holders a basket having rectangular end members 14 of roughly 3¼ x 3⅞ inch size, a length of about 5⅝ inches, and a spacing between the two bottom rod segments of roughly 1 inch, all measured as outside dimensions, is particularly suitable for my purpose.

Disposed between the two bottom rod segments 22, but attached to the undersides of the bottom segments of the rectangular end members 14 by spot welding, is a center rod segment 24. As can be seen from the drawing, there is a downturned leg 20 at the same end of each of the two bottom rails 18, and a downturned leg 26 at the opposite end of the center bottom rod 24. These legs are adjusted in length to provide flat, stable support for the basket on a horizontal surface.

Figure 3:
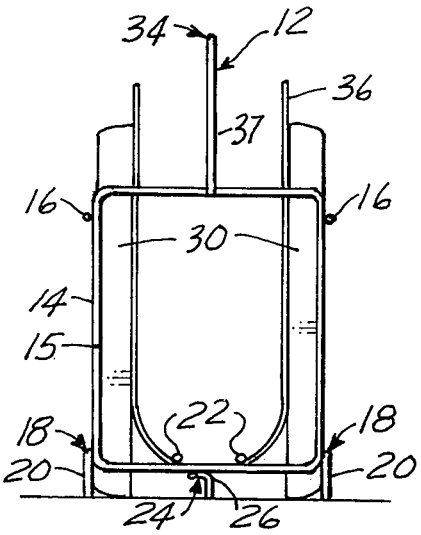
FIG. 3 is an end elevation of the FIG. 1 rack loaded with a pair of napkin holder sides for emplacement on a mold for the bottom of said napkin holder.
Figure 4:
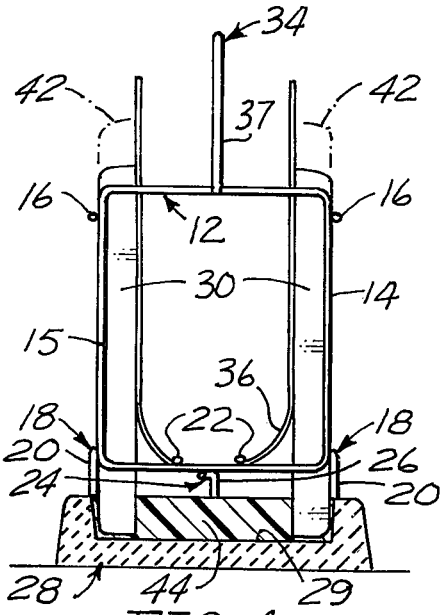
FIG. 4 is an end view of the loaded rack positioned on said mold and showing the napkin holder sides pushed downwardly from their FIG. 3 positions into the cavity of said mold, a plastic bottom for the napkin holder being shown in said mold and the plastic bottom and mold being shown in cross-section for better illustrative effect.

As best shown in FIGS. 1, 3 and 4, the resilient sheet 36 is bent into a substantially U-shaped curvature in the basket 12 so that its two halves extend upwardly from the bottom of the basket and bear outwardly against its sides. At its center, in the bottom of basket 12, the sheet is threaded through the tight space between the bottoms of the two rods 22 and the top of the center rod segment 24, to provide a firm friction fit between the sheet and the bottom of the basket and thereby prevent migration of said sheet during utilization of the rack 10. The fit between sheet 36 and the rod segments 22 and 24 of basket 12 is too tight to permit emplacement of the sheet in the basket after those segments are secured in place, hence the sheet is guided into position during the basket welding procedure so as to be properly anchored when the rod segments are made secure.

The rack 10 is designed to receive a pair of flat members, such as the preformed sides of conventional open-topped napkin holders, between the sides of basket 12 and the upturned halves of the resilient sheet 36 in the manner illustrated in FIG. 3, where two such sides of a napkin holder are shown at 30. The napkin holder sides 30 can be formed of any suitable material, such as, for example, wood, but are preferably of molded plastic, e.g., polyester plastic, construction. Any polyester casting resin of conventional type, of which there are many, is suitable for use in the preparation of plastic napkin holder sides. Such casting resins are generally designated by generic name and catalog number, as illustrated by, for example, casting resin 50114 (manufactured by Pittsburgh Plate & Glass Industries), polyester resin 32-036 Reichhold Chemicals, Inc.), and water-extended polyester resin 32-177 (Reichhold). All of these resins are mixtures of aromatic acid components and dihydric alcohols, dissolved in styrene polymer, the acid components comprising phthalic anhydride, maleic anhydride, and adipic acid, and the dihydric alcohols comprising propylene glycol and diethylene glycol. Other materials (besides wood and polyester resins) from which napkin holder sides can be formed include materials equivalent to polyester resins in molding properties, typical of which are epoxy casting mixtures, plaster of Paris, etc. Suitable dyes, coloring pigments, or the like, can be incorporated in the castings to achieve desired color effect if desired. Furthermore, and as previously indicated, the napkin holder sides can be formed from clear plastic embedded with decorative objects of one form or another.

Figure 5:
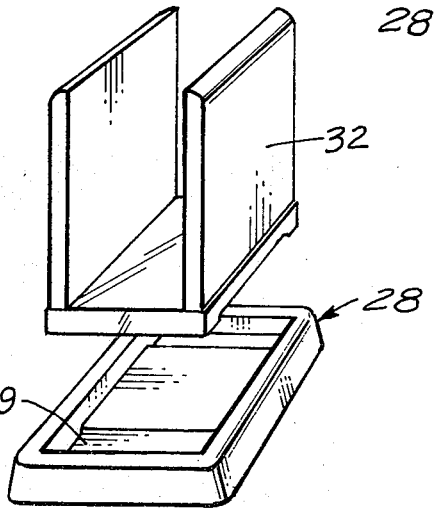
FIG. 5 is a perspective view of the finished napkin holder and mold, drawn to a reduced scale, as the napkin holder appears upon removal of the rack from the mold and subsequent removal of the napkin holder from said rack.

The napkin holder sides 30 can be inserted within the rack 10 from either the top or bottom, but preferably from the bottom because it is easier to start the sliding operation for proper positioning of the sides in the rack from there. Preferably, the napkin holder sides should be pushed upwardly to positions at which their lower edges are high enough so as not to interfere with the stability of the rack standing on a flat surface, representative positions of this type being illustrated in FIG. 3 of the drawing. The loading of rack 10 with the napkin holder sides represents the first step in the actual production of a napkin holder utilizing said rack, unless the molding of said sides can be considered the first step. In any event, after the napkin holder sides are inserted in the rack, the next step of production is to position the loaded rack on top of a suitable casting mold for the bottom of the napkin holder, such a mold being illustrated at 28 in FIGS. 4 and 5. The positioning of the loaded rack must be such that the napkin holder sides 30 are disposed above the side edges of a cavity 29 in the mold, the basket 12 and mold 28 being designed to cooperate as necessary to yield a napkin holder of attractive and functional symmetry when the steps described herein are followed. After the loaded rack 10 is positioned on the mold 28, the two napkin holder sides 30 are pushed downwardly, preferably as far as they will go, into the mold cavity 29. FIG. 4 shows the lowered positions of the napkin holder sides after being so pushed in the mold cavity, the upper, of starting, positions of said sides being indicated at 42 by phantom lines.

Following the insertion of the sides 30 of the napkin holder into the mold cavity, a suitable casting material of liquid consistency, such as, for example, a polyester resin casting mix of the type referred to above, is poured into the cavity 29. Sufficient time is permitted to allow the casting mixture to set and form a bottom, or base, 44 for the napkin holder (see FIG. 4). The rack 10 and napkin holder can then be lifted clear of the mold 28, after which the napkin holder can be pulled downwardly and out of the rack. The finished napkin holder, after removal from the rack, is illustrated at 32 in FIG. 5.

While the mold 28 is shown in the drawing to be of ceramic construction, it could, of course, be made of any other material suitable for the purpose, such as, for example, polyethylene plastic, steel, rubber, or the like.

As will now be readily apparent, the unique holding device of this invention serves to firmly hold a pair of napkin holder sides in their proper positions while an integral bottom for the napkin holder is being molded, to thereby insure the provision of a high-quality product of precise symmetry and attractive appearance.

Through use of the holding device, the napkin holder sides are prevented from floating or tilting out of position during the bottom-molding step (as they frequently do during present manufacturing procedures) to yield unsymmetrical or misshapen products of lessened attractiveness and buyer appeal.

As previosuly indicated, the resilient sheet 36 which gently but firmly urges the napkin holder sides 30 against the sides of basket 12 is preferably formed from low-density polyethylene sheet material. This material is commercially available for mold-forming purposes from various sources, such as, for example, Alchem Plastics, Inc., of La Mirada, California. It is typically sold in the form of square or rectangular pieces (of suitable size for individual purchaser needs) of specified thickness. I have found it particularly advantageous to obtain the polyethylene in sheets 22 × 24 inches in size, and of the preferred 90-mil thickness, and cut these sheets down to the proper size for my purpose. Suitably appropriate materials other than polyethylene can, as indicated above, be employed in lieu thereof if desired. For example, a suitably resilient sheet of steel or other type of metal, could be substituted for the polyethylene, or, a material such as RTV Silastic, the proprietary name of a silicone rubber product of Dow-Corning Corp., manufactured primarily for use in the preparation of molds for 3-dimensional objects, could be so employed.

While my novel holding device has been herein described and illustrated in what I consider to be its preferred embodiment, it will be appreciated by those skilled in the art that my invention is not limited to that particular embodiment, but is broad enough in scope to encompass all modifications thereof incorporative of the structural and functional essence of the invention as taught herein. Certain of these modifications have already been mentioned, and others will occur to those skilled in the art in the light of present teachings. Examplary of the latter are non-critical variations of the shapes, sizes, and relative positions of the parts of the illustrated rack; the elimination of certain features of the rack not critically essential to its proper use and functioning the inclusion of various features not essential to the proper use and functioning of the rack; etc.

Although I have herein stressed the applicablility of the novel holding means of this invention for use in the production of napkin holders of the type having molded plastic bottoms, it should, of course, be understood that the device might well have broader use potential than this, and can be employed in any capacity for which its unique character and capabilities suit it. Finally, it is emphasized that the scope of the present invention includes all variant forms thereof encompassed by the language of the following claims.

What I claim is:

1. Holding means for frictionally engaging a pair of relatively smooth-sided flat members and thereby confine them in any of a plurality of fixed positions in spaced apart paths of travel, the resulting frictional forces on said flat members from said holding means being yieldable to permit easy movement of said flat members between different ones of said fixed positions;

said holding means being also adapted to firmly hold said flat members in positions of downward extension into the cavity of a cooperating casting mold of such character that a web-like body interconnecting the flat members at the bottom can then be formed therein;

said holding means comprising generally box-shaped basket-like means adapted to receive said pair of relatively smooth-sided flat members, said basket-like means having a pair of opposite sides against which said flat members can fit flush when pushed outwardly towards same, said holding means comprising, additionally, resilient means associated with said basket-like means and adapted to bear outwardly against said flat members and hold them flush against said opposite sides, when the flat members are positioned between the resilient means and said opposite sides, and thereby create said frictional forces on said flat members;

said holding means being paricularly adapted for use in the manufacture of an open-topped napkin holder of the type having planarly parallel sides and a flat, integral bottom, wherein said flat members are preformed sides for said napkin holder and said web-like body forms the bottom of the napkin holder;

said box-shaped basket-like means being a skeletal structure made of relatively thin steel rods and having at least three legs adapted to provide stable support on the top of said mold, said top comprising a rim around the cavity in the mold, so that a pair of napkin holder sides loaded in said holding means can be pushed downwardly into said cavity and then be held firmly between the resilient means and the opposite sides of said basket-like means until an integral bottom for the napkin holder is cast in said cavity, the fit between the downwardly extending napkin holder sides and the cavity being preferably snug enough to substantially prevent lateral movement of said holding means relative to said mold;

said resilient means being a rectangular sheet of plastic material firmly secured transversely across its center at the bottom of said basket-like means so that its half segments either side of the center curve upwardly to make resilient frictional contact with said opposite sides, the rectangular sheet having a resiliency such as to cause its curved halves to bear against said opposite sides with pressures sufficiently low that said napkin holder sides can be manually inserted between the half segments and opposite sides, yet high enough so that said half segments hold the napkin holder sides firmly in position, said resiliency also being such that said napkin holder sides can be manually shifted, either before or after the sides are interconnected with the molded napkin holder bottom.

2. Holding means in accordance with claim 1 in which said skeletal structure comprises a pair of end frames of rectangular shape with top and bottom horizontal segments, a pair of generally parallel top rails running between the end frames from points near their top portions, a pair of generally parallel bottom rails running between the end frames from points near their bottom portions, said top rails and said bottom rails forming said opposite sides of said basket-like means, a pair of generally parallel, spaced apart bottom rods positioned intermediate said opposite sides and fixedly secured, near their ends, to the upper edges of the botttom segments of said end frames, and a center rod spaced between said generally parallel rods, but fixedly secured, near its ends, to the lower edges of said bottom segments of said rectangular end frames.

3. Holding means in accordance with claim 2 in which said rectangular sheet of plastic material is anchored at the bottom of said basket-like means by passage through the space between the pair of generally parallel bottom rods and said center rod so that it underlies said parallel rods and overlies said center rod, the thickness of the sheet of plastic material being such as to assure a sufficiently tight fit thereof in said space to secure the sheet firmly in position at its center.

4. Holding means in accordance with claim 3 in which said at least three legs are three in number, two of which are downturned end extremities of said pair of generally parallel bottom rails and the third of which is a downturned end extremity of said center rod, said end extremities occuring at a first side of said skeletal structure and said end extremity occurring at a second side, opposite said first side, of said skeletal structure.

5. Holding means in accordance with claim 4 in which said rectangular sheet of plastic is formed of low-density polyethylene.

6. Holding means in accordance with claim 5 having a handle formed from a length of suitable steel rod, said length of steel rod having a straight central segment and a pair of downturned end portions, the latter being of substantially equal length and being fixedly secured to substantially the centers of the top horizontal segments of the rectangular end frames of said skeletal means so as to extend perpendicularly upwardly therefrom.

* * * * *